United States Patent [19]

Raux et al.

[11] Patent Number: 4,703,988

[45] Date of Patent: Nov. 3, 1987

[54] SELF-LOCKING ELECTRIC CONNECTOR

[75] Inventors: Jacques Raux, Meudon-la-Foret; Georges Muzard, Clichy, both of France

[73] Assignee: Souriau et Cie, Boulogne-Billancourt, France

[21] Appl. No.: 895,229

[22] Filed: Aug. 11, 1986

[30] Foreign Application Priority Data

Aug. 12, 1985 [FR] France ..... 85 12289

[51] Int. Cl.[4] ..... H01R 13/623

[52] U.S. Cl. ..... 439/321; 439/488

[58] Field of Search ..... 339/DIG. 2, 89 R, 89 L, 339/89 M, 113 R, 113 L

[56] References Cited

U.S. PATENT DOCUMENTS

| | | | |
|---|---|---|---|
| 3,517,371 | 6/1970 | Buckley | 339/DIG. 2 |
| 3,552,777 | 1/1971 | Heinrich et al. | 339/89 R |
| 3,786,396 | 1/1974 | Kemmer et al. | 339/89 R |
| 3,808,580 | 4/1974 | Johnson | 339/89 R |
| 3,917,373 | 11/1975 | Peterson | 339/89 R |
| 4,030,798 | 6/1977 | Paoli | 339/89 R |
| 4,462,653 | 7/1984 | Flederbach et al. | 339/DIG. 2 |
| 4,500,153 | 2/1985 | Mattingly, Jr. et al. | 339/DIG. 2 |
| 4,531,798 | 7/1985 | Baur et al. | 339/113 L |
| 4,534,607 | 8/1985 | Tomsa | 339/DIG. 2 |

*Primary Examiner*—John McQuade

*Attorney, Agent, or Firm*—Fleit, Jacobson, Cohn & Price

[57] ABSTRACT

A self-locking electrical connector comprises a first connector element having a housing including a radially directed flange formed with radial slots, an internally threaded locking bush rotatably and slidably received on the housing and a stop ring fixed to the bush and formed with ratchet indentations distributed about the connector axis, a second connector element has a threaded body. A spring washer is axially retained between the stop ring and the flange. It has a plurality of keying fingers engaged into the slots for preventing mutual rotation of the housing and spring washer, is axially curved away from the housing between the fingers and is formed with projecting deformations located midway between the fingers for engagement into the ratchet identations by the resiliency of the washer.

6 Claims, 3 Drawing Figures

SELF-LOCKING ELECTRIC CONNECTOR

BACKGROUND OF THE INVENTION

1. Field of the Invention

The present invention relates to self-locking electrical connectors comprising two mutually mating halves or elements, one of which comprises a housing containing contacts and a locking bush rotatably connected to the housing and threaded for cooperation with an external thread of the other element. It is particularly suitable for use in the aircraft industry, where vibrations are liable to loosen threaded connections and where bayonet couplings have drawbacks which render the unsuitable for many uses, and particularly for connectors for electrical circuits associated with engines.

2. Description of the Prior Art

There exist numerous types of self-locking connectors, comprising an elastic member engaging in notches or bosses in particular angular positions of the elements of a threaded connection. Examples of such connectors are described in French No. 1 168 745, U.S. Pat. Nos. 3,552,777, 3,808,580 and 4,109,990. Some such connectors are also provided with means enabling visual or tactile verification that the connection is sufficiently tight for the locking to be effective. Connectors have also been proposed where locking is achieved using additional means (German No. 1910073).

SUMMARY OF THE INVENTION

It is an object of the invention to provide an improved self-locking connector. It is a more specific object to provide such a connector which is simple in construction, preserves its reliability after numerous thermal cycles and whose locked condition may easily be checked.

With this object in mind, there is provided a connector comprising two mutually mating elements. One of the elements has a contact containing housing with a radially directed flange formed with radial slots, an internally threaded locking bush rotatably and slidably received on the housing and a stop ring fixed to the bush and formed with axially directed ratchet indentations angularly distributed about the connector axis. The other element has an external thread arranged for cooperating with the bush. A spring washer having a plurality of keying fingers engaged into the slots for preventing mutual rotation of the housing and spring washer, axially curved away from the housing between the fingers and formed with projecting deformations located midway between the fingers for engagement into the ratchet indentations by the resiliency of the washer. The washer is axially retained between the stop ring and the flange for being put under axial compression upon tightening of the threaded connection of the bush with the external thread. The ratchet indentations may preferably have a dissymetric shape so as to oppose unscrewing with a torque greater than the screwing torque. In particular, the indentation may be defined by one leading surface substantially parallel to the connector axis and a trailing surface forming an angle of from 45° to 60° with the axis. The indentations may merge with the front surface of the ring by an oblique side so as to avoid rapid wear.

When a visual indication is required, windows parallel with the axis are formed in the bush at a position such that the flange appears across the window when the screwed connection is fully tightened. A coloured circle or a groove of shallow depth may be formed on the bush where the flange appears when sufficient tightening and actual locking have been achieved.

In a typical embodiment, the bush carries a tubular spacer in axial abutment with the ring for limiting the extent of closing movement of the ring and collar and squeezing of the washer. Then the threaded connection may be tightened until there is positive abutment. Other types of abutment means are however suitable.

The curved washer will typically have a wave shape, with a curved resilient portion between two successive fingers and a projecting deformation constituting a pawl formed halfway in the curved portion as a half cylindrical deformation of the washer. Abutment means may be formed on the spring washer for limiting flattening of the washer. Such abutment means may consist of tabs of the washer. Two fingers and two projecting deformations will generally be sufficient. However, a greater number may be used for connectors of large diameter.

The invention will be better understood from the following description of a connector constituting a particular embodiment of the invention, given by way of example, designed to operate at high temperature.

DETAILED DESCRIPTION OF A PREFERRED EMBODIMENT

Figure 1:
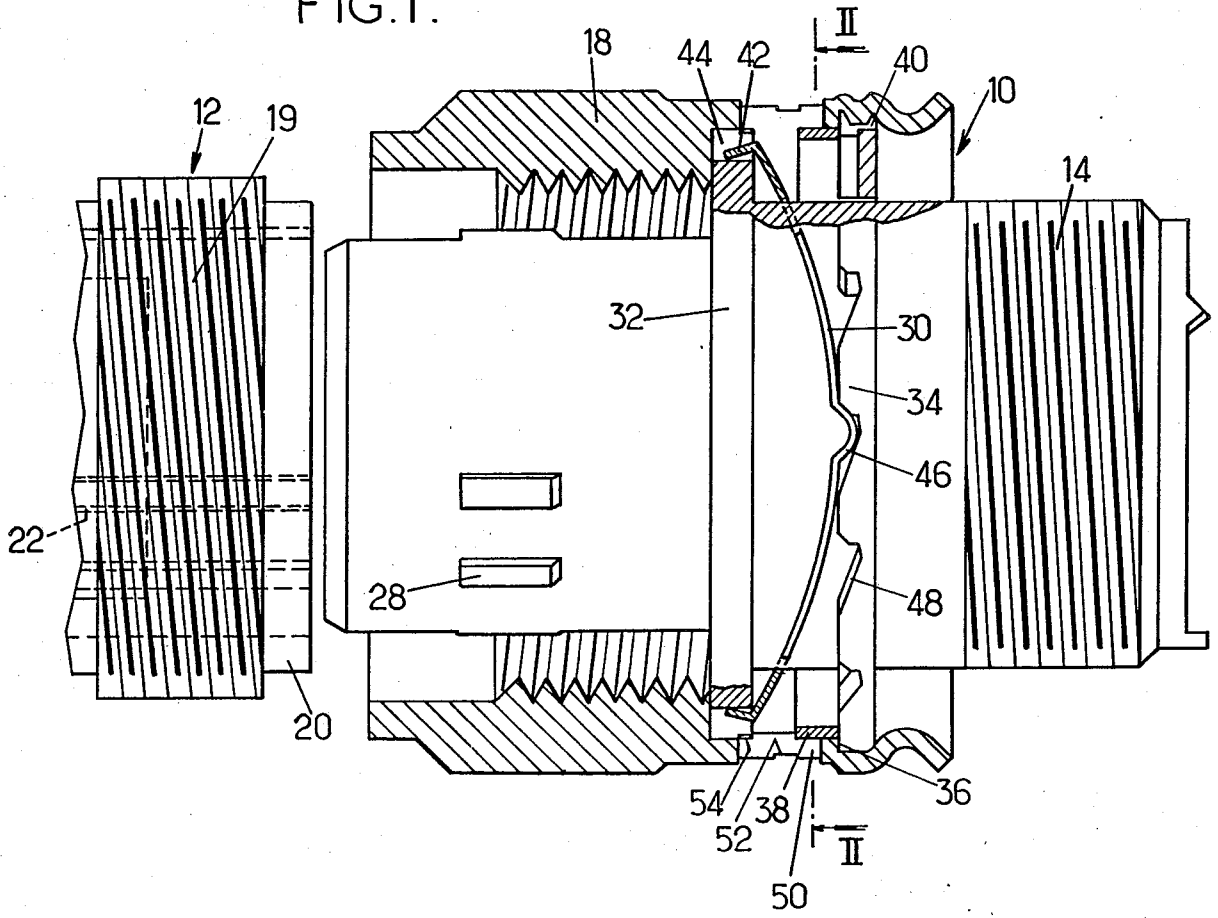
FIG. 1 is a view in elevation and in partial section of part of the connector, the two elements thereof being completely separated.
Figure 3:
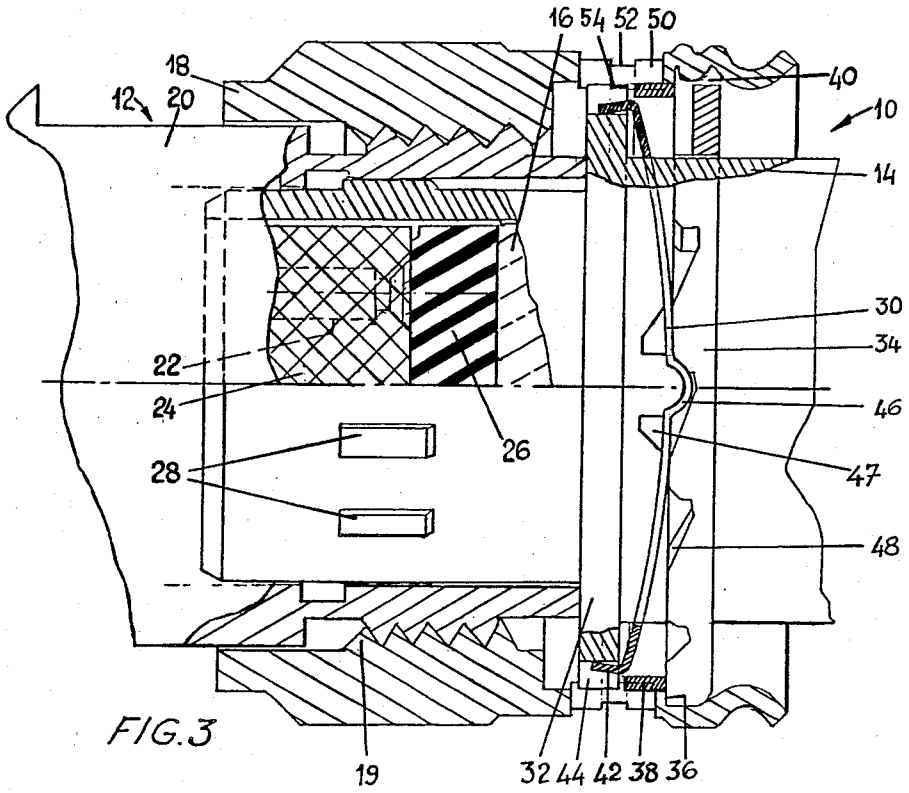
FIG. 3, similar to part of FIG. 1, shows the two connector elements at the end of tightening of the threaded connection.
Figure 2:
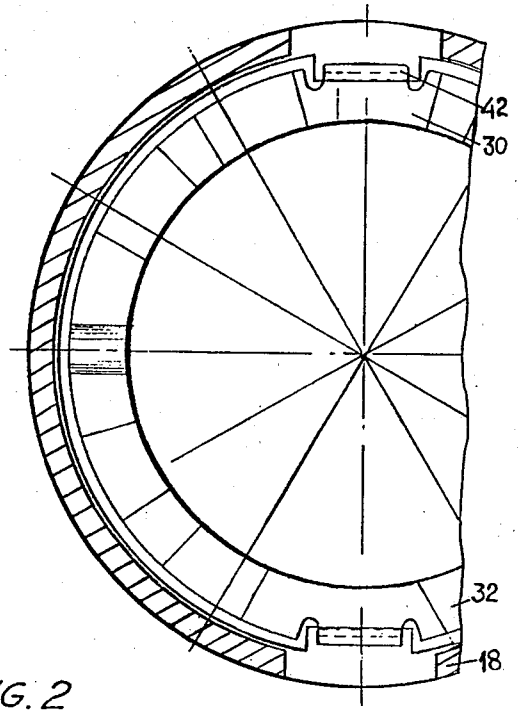
FIG. 2 is a view in section along line II—II of FIG. 1.

Referring to FIGS. 1 to 3, a connector comprises two mating elements 10 and 12. The element 10 comprises a body 14 containing an insulator 16 of hard insulating material (FIG. 3) for receiving contact elements such as pins (not shown). The element 10 also comprises a locking bush 18 internally threaded over part of its length and designed to be screwed onto a threading 19 of a body 20 of the second element 12. Body 20 contains contact elements such as sockets 22 retained in a cylindrical insulator 24 formed with openings for the sockets. A pad of insulating elastomeric material 26 is placed in one of the bodies to constitute an interface separating the hard insulators. To avoid any angular error on insertion, anti-error projections 28 are provided on one of the bodies and cooperate with longitudinal slits 22' on the other body.

The first connector element will, for example, be a plug attached to a cable, whilst the other connector element is a fixed socket.

Resilient contact means and ratchet means are provided between the body 14 and the locking bush 18. They comprise a spring washer 30 compressed between a flange 32 belonging to body 14 and an abutment ring 34 fast with the bush 18. The ring 34 may be fixed in the bush against axial movement by radially deforming a skirt of the bush behind the ring for immobilizing the ring 34 against a shoulder 36 of the bush. A tubular spacer 38, whose purpose will appear later, is clamped in the bush between ring 34 and a second radial shoulder in the bush.. The ring is retained against rotation with respect to the bush by a local inwardly directed projection of the latter engaged into a notch 40 of the ring 34.

The washer 30, generally constituted as a flexible flat piece of spring steel, has a plurality of keying lugs or fingers 42 distributed regularly, two in number as shown. The two fingers, constituted by folded excrescences of the washer 30, engage into notches 44 formed in flange 32, so that the washer is non rotatably connected to the body 14. The washer 30 further has an abutting connection on flange 32 in the zones adjacent to the fingers 42.

The washer 30 has a curved convex shape between adjacent fingers. It is locally shaped in the middle of each curved portion so as to constitute catch projecting deformations 46. The resiliency of the washer forces the deformations 46 against the ring 34. A plurality of ratchet indentations 48, (ten in number in the embodiment illustrated) are formed at equal angular intervals on the ring 34 for receiving the deformations 46. The ratchet indentations are of dissymetric shape, so that a stronger torque is required for unlocking the ratchet connection by forcing the projecting deformations 46 out of the indentations than for tightening, which is favourable for security. As shown, one of the flanks of each indentation 48 has a slope with respect to the axis of about 60° whilst the other flank is substantially parallel to the axis in the portion thereof closer to the bottom of the indentation; it is sloped in the mouth portion to reduce wear and for adaptation to the shape of the projecting deformations 46. The trailing surface of the indentations can have a slope with respect to the axis of from 45° to 65°.

A visual indication of locking is ensured by at least one window 50 formed in the bush 18 (two windows being provided in the illustrated embodiment). A shallow groove 52, possibly coloured, may be cut out to indicate the position where the collar 32 should arrive when the bush 18 has been fully tightened. The edge of this bush may, for easier visual monitoring, bear a color strip 54.

The steps in assembling the connector are clear from the foregoing description and will consequently be described briefly. The two elements are axially moved toward each other and the body 14 is forced into the body 20, the anti-error projections 28 providing a guarantee that the mutual orientation is correct. Then the bush 18 is screwed onto the threaded part 19 of the body 20. After a predetermined amount of travel, the radial end surface of the body 12 abuts flange 32. Further rotatation of the bush 18 causes compression of the spring washer. Each projecting deformation 46 is pressed against the ring 34, snaps into successive indentations and passes from one indentation 48 to the next one, the resistant torque being slight due to the slope of the trailing surfaces of the indentations. However, this torque steadily increases due to increased compression of the washer 30 between the flange 32 and the ring 34 approaching one another. During that compression, the flange 32 advances along the windows 50 toward the tubular spacer 38. The tightening action can be stopped in a position for which the indicator 54 appears opposite the colored groove 52. In practice, the travel of the flange 32 with respect to the bush, after abutment of body 20 with the flange and until the flange comes into abutment with the spacer 38 (or another form of stop), may be of some millimeters only. Due to the stop means limiting the travel, the screwing action cannot be continued to a point which would completely flatten the washer 30 and would possibly modify its mechanical characteristics.

In the final condition, the elements are as shown in FIG. 3. The washer 30 locks the ring 34 in a fixed angular position. Since the torque necessary for loosening is much higher than that which allows tightening, the locking action is sufficiently strong to avoid loosening under the effect of vibration. However, by manually exerting on the bush 18 a sufficient unscrewing torque it is possible to separate the connector elements.

We claim:

1. A self-locking electrical connector comprising:

a first connector element having a housing for receiving contacts, said housing including a radially directed flange formed with radial slots, an internally threaded locking bush rotatably and slidably received on the housing and a stop ring fixed to the bush and formed with axially directed ratchet indentations angularly distributed about the connector axis, a second connector element having a body formed with an external thread for cooperation with said bush, and a spring washer axially retained between said stop ring and said flange, having a plurality of keying fingers engaged into the slots for preventing mutual rotation of the housing and spring washer, axially curved away from the housing between the fingers and formed with projecting deformations located midway between the fingers, said deformations being constructed and arranged for engagement into the ratchet indentations by the resiliency of the washer, wherein said indentations have a dissymetric shape on the circumferential direction so as to oppose unscrewing with a torque greater than the screwing torque.

2. A connector as claimed in claim 1, wherein each of said indentations has a trailing surface which is at an angle of from 45° to 65° with the connector axis and a leading surface which is substantially parallel to the connector axis.

3. A self-locking electrical connector comprising:

a first connector element having a housing for receiving contacts, said housing including a radially directed flange formed with radial slots, an internally threaded locking bush rotatably and slidably received on the housing and a stop ring fixed to the bush and formed with axially directed ratchet indentations angularly distributed about the connector axis, a second connector element having a body formed with an external thread for cooperation with said bush, and a spring washer axially retained between said stop ring and said flange, having a plurality of keying fingers engaged into the slots for preventing mutual rotation of the housing and spring washer, axially curved away from the housing between the fingers and formed with projecting deformations located midway between the fingers, said deformations being constructed and arranged for engagement into the ratchet indentations by the resiliency of the washer, wherein windows parallel with the axis are formed in the bush at a position such that the flange appears across the windows when the screwed connection is fully tightened.

4. A connector as claimed in claim 1, wherein at least one axially elongated window is formed in said bush at such a location that the flange is axially aligned with said window when the connector is in fully tightened condition.

5. A connector as claimed in claim 1, further comprising spacer means secured to said bush and cooperating with said flange to provide a minimum spacing between said flange and ring and to prevent flattening of said spring washer.

6. A connector as claimed in claim 1, wherein the washer has a wave shape with a curved resilient portion between two successive of said fingers and said projecting deformations constitute pawls formed halfway in the curved portion as half cylindrical deformations of the washer.

* * * * *